US011121511B1

(12) United States Patent
Long et al.

(10) Patent No.: US 11,121,511 B1
(45) Date of Patent: Sep. 14, 2021

(54) ELECTRICAL CONNECTOR WITH SHIELDING GASKET

(71) Applicant: TE Connectivity Services GmbH, Schaffhausen (CH)

(72) Inventors: Richard James Long, Columbia, PA (US); Alex Michael Sharf, Harrisburg, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/819,620

(22) Filed: Mar. 16, 2020

(51) Int. Cl.

| | |
|---|---|
| ***H01R 9/03*** | (2006.01) |
| ***H01R 24/50*** | (2011.01) |
| ***H01R 12/71*** | (2011.01) |
| ***H01R 13/24*** | (2006.01) |
| ***H01R 13/6594*** | (2011.01) |
| *H01R 103/00* | (2006.01) |

(52) U.S. Cl.
CPC ..... *H01R 24/50* (2013.01); *H01R 12/716* (2013.01); *H01R 13/2421* (2013.01); *H01R 13/6594* (2013.01); *H01R 2103/00* (2013.01)

(58) Field of Classification Search
CPC .. H01R 24/50; H01R 13/2421; H01R 12/716; H01R 13/6594; H01R 2103/00
USPC ..... 439/82, 66, 700, 824, 607.35, 607.36
See application file for complete search history.

(56) References Cited

U.S. PATENT DOCUMENTS

| | | | | |
|---|---|---|---|---|
| 4,743,201 | A * | 5/1988 | Robinson | H01R 13/2421 439/10 |
| 5,076,794 | A * | 12/1991 | Ganthier | H01R 12/714 439/70 |
| 5,702,255 | A * | 12/1997 | Murphy | H01R 13/2478 439/71 |
| 6,249,440 | B1 * | 6/2001 | Affolter | H01R 13/2464 257/678 |
| 6,672,881 | B2 * | 1/2004 | Evans | H05K 7/1084 439/331 |
| 6,743,026 | B1 * | 6/2004 | Brodsky | H05K 3/325 361/719 |
| 6,769,919 | B2 * | 8/2004 | Kosmala | H01R 12/73 439/66 |
| 6,937,045 | B2 * | 8/2005 | Sinclair | G01R 1/0466 324/755.05 |
| 7,057,403 | B2 * | 6/2006 | Kazama | G01R 1/06722 324/755.05 |
| 7,196,907 | B2 * | 3/2007 | Zheng | H01R 13/2435 361/760 |

(Continued)

*Primary Examiner* — Abdullah A Riyami
*Assistant Examiner* — Nelson R. Burgos-Guntin

(57) ABSTRACT

A electrical connector includes an inner conductor having a first mating end configured to be coupled to an electrical component and a second mating end and an outer conductor having a first mating end configured to be coupled to the electrical component and a second mating end. The outer conductor has a bore receiving the inner conductor. The inner conductor is coaxial with the outer conductor. A shielding gasket is separate and discrete from the outer conductor and coupled to the first mating end of the outer conductor. The shielding gasket has an outer surface facing the electrical component and configured to interface with the electrical component. The shielding gasket provides perimeter shielding around the first mating end of the inner conductor.

26 Claims, 5 Drawing Sheets

(56) References Cited

U.S. PATENT DOCUMENTS

| | | | | |
|---|---|---|---|---|
| 7,470,149 | B2 * | 12/2008 | Kazama | G01R 1/0483<br>439/607.05 |
| 7,476,132 | B2 * | 1/2009 | Xu | H01R 13/2421<br>439/66 |
| 7,641,516 | B1 * | 1/2010 | Scott | H01R 13/7197<br>439/607.12 |
| 7,874,880 | B2 * | 1/2011 | Fedde | H01R 13/2471<br>439/841 |
| 8,535,093 | B1 * | 9/2013 | Mason | H01R 13/6585<br>439/607.05 |
| 8,956,193 | B2 * | 2/2015 | Tran | G01R 1/06722<br>439/700 |
| 9,748,686 | B1 * | 8/2017 | Milo | H01R 13/2421 |
| 2008/0064270 | A1 * | 3/2008 | Ohshima | H01R 13/2421<br>439/841 |

* cited by examiner

ELECTRICAL CONNECTOR WITH SHIELDING GASKET

BACKGROUND OF THE INVENTION

The subject matter herein relates generally to electrical connectors.

Electrical connectors are used in communication systems, such as in antennas. For example, the electrical connectors may be coaxial connector having an outer conductor and an inner conductor coaxial within the outer conductor. The outer conductor provides electrical shielding for the inner conductor. The electrical connector may be provided at an end of a cable, such as a coaxial cable, or may be mounted to a circuit board. In various embodiments, the electrical connector is used as a board-to-board connector. However, board mounted electrical connectors are not without disadvantages. For instance, at the board interface, there may be gaps in the electrical shielding provided by the outer conductor. For instance, one side of the outer conductor may be lifted slightly off of the board interface leaving a gap. The ground pads may include protrusions, causing the ground pads to be elevated off of the board interface, leaving gaps in the electrical shielding.

A need remains for a electrical connector having an improved mating interface with an electrical component.

BRIEF DESCRIPTION OF THE INVENTION

In one embodiment, a electrical connector is provided including an inner conductor having a first mating end configured to be coupled to an electrical component and a second mating end and an outer conductor having a first mating end configured to be coupled to the electrical component and a second mating end. The outer conductor has a bore receiving the inner conductor. The inner conductor is coaxial with the outer conductor. A shielding gasket is separate and discrete from the outer conductor and coupled to the first mating end of the outer conductor. The shielding gasket has an outer surface facing the electrical component and configured to interface with the electrical component. The shielding gasket provides perimeter shielding around the first mating end of the inner conductor.

In an embodiment, a electrical connector is provided including an inner conductor and an outer conductor. The inner conductor has a first mating end configured to be coupled to an electrical component and a second mating end. The inner conductor is compressible between the first mating end and the second mating end. The outer conductor has a first mating end configured to be coupled to the electrical component and a second mating end. The outer conductor is compressible between the first mating end and the second mating end. The outer conductor has a bore receiving the inner conductor. The inner conductor is coaxial with the outer conductor. A biasing spring is coupled to the outer conductor to bias the first mating end away from the second mating end. A shielding gasket is separate and discrete from the outer conductor and coupled to the first mating end of the outer conductor. The shielding gasket has an outer surface facing the electrical component and configured to interface with the electrical component. The shielding gasket provides perimeter shielding around the first mating end of the inner conductor.

In an embodiment, a communication system is provided including a first electrical component having first mounting surface and a second electrical component having a second mounting surface. A electrical connector is electrically connected between the first electrical component and the second electrical component. The electrical connector includes an inner conductor and an outer conductor. The inner conductor has a first mating end coupled to the first mounting surface and a second mating end coupled to the second mounting surface. The inner conductor is compressible between the first mating end and the second mating end. The outer conductor has a first mating end and a second mating end with a bore receiving the inner conductor. The outer conductor is coaxial with the inner conductor. The first mating end of the outer conductor is coupled to the first mounting surface and the second mating end of the outer conductor is coupled to the second mounting surface. The outer conductor is compressible between the first mating end and the second mating end. A biasing spring is coupled to the outer conductor to bias the first mating end away from the second mating end. A shielding gasket, separate and discrete from the outer conductor, is coupled to the first mating end of the outer conductor. The shielding gasket has an outer surface facing the first mounting surface and configured to interface with the first electrical component at the first mounting surface. The shielding gasket provides perimeter shielding around the first mating end of the inner conductor.

DETAILED DESCRIPTION OF THE INVENTION

Figure 1:
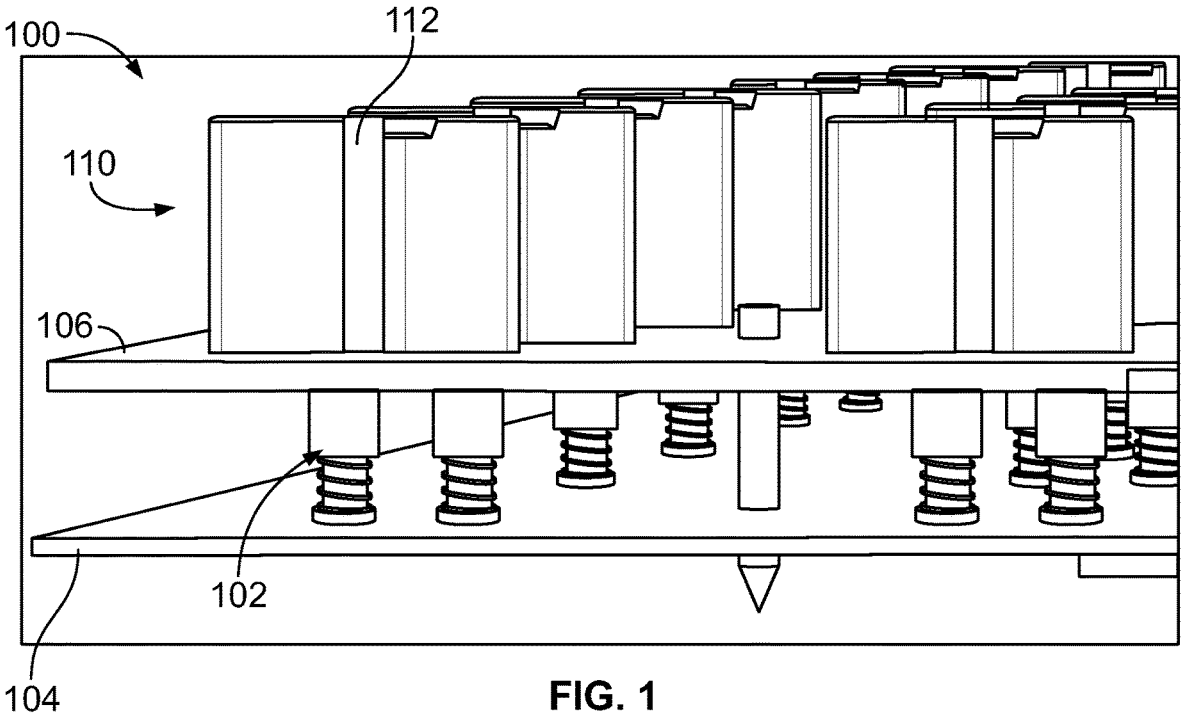
FIG. 1 is a perspective view of a communication system including electrical connectors in accordance with an exemplary embodiment.

FIG. 1 is a perspective view of a communication system 100 including electrical connectors 102 in accordance with an exemplary embodiment. The electrical connectors 102 are used to electrically connect a first electrical component 104 with a second electrical component 106. In the illustrated embodiment, the first electrical component 104 is a circuit board and may be referred to hereinafter as a first circuit board 104 and the second electrical component 106 is a circuit board and may be referred to hereinafter as a second circuit board 106. However, in alternative embodiments, the first electrical component 104 and/or the second electrical component 106 may be an electrical connector, a cable, another electrical connector 102, or another type of component having electrical conductors. In an exemplary embodiment, the electrical connectors 102 are coaxial connectors and the electrical components 104, 106 include coaxial conductors (for example, inner and outer conductors) for electrical connection with the electrical connectors 102. However, the conductors of the electrical connectors 102 may be arranged in other orientations other than coaxial in alternative embodiments. While the description herein may be in reference to coaxial electrical arrangements, it is realized that the electrical connectors 102 may have other than coaxial arrangements in alternative embodiments and the subject matter herein is not intended to be limited to coaxial arrangements. The electrical connectors 102 may be used to electrically connect other types of components in alternative embodiments. In various embodiments, rather than being board mounted, the electrical connectors 102 may be provided at ends of cables to electrically connect the cables to the circuit board 104.

In an exemplary embodiment, the communication system 100 includes an antenna array 110 of antennas 112 provided on the circuit boards, such as the second circuit board 106. The antennas 112 are electrically connected to corresponding electrical connectors 102. The communication system 100 may include other types of communication components in alternative embodiments.

Figure 2:
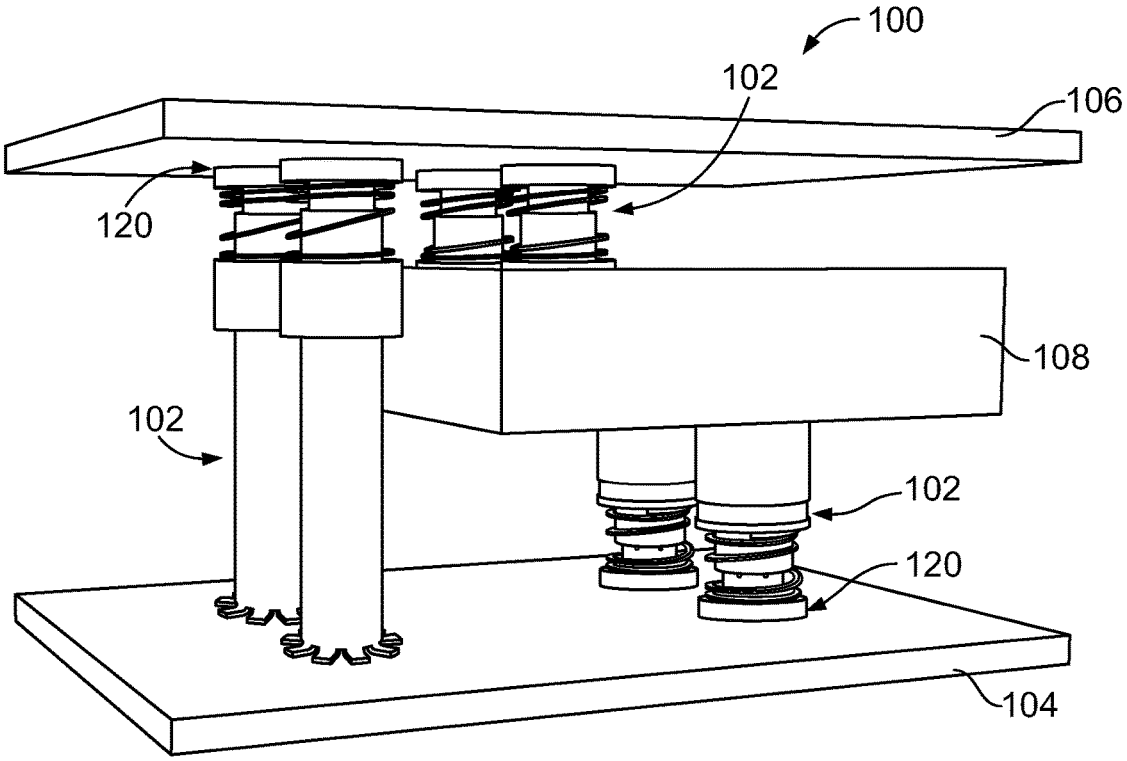
FIG. 2 is a perspective view of the communication system in accordance with an exemplary embodiment.

FIG. 2 is a perspective view of the communication system 100 in accordance with an exemplary embodiment. In an exemplary embodiment, the electrical connectors 102 are electrically connected between the first and second circuit boards 104, 106. In an exemplary embodiment, the communication system 100 may include an interposer 108, such as a filter. The electrical connectors 102 are electrically connected between the interposer 108 and the circuit boards 104, 106.

In an exemplary embodiment, the electrical connectors 102 are spring-loaded coaxial connectors. For example, one of the ends of the electrical connector 102 is configured to be spring biased against the corresponding circuit board 104 or 106 at a separable mating interface. The other end of the electrical connector 102 is configured to be permanently mounted to the other circuit board 104 or 106. For example, the end of the electrical connector 102 may be soldered to the circuit board 104, 106 in other various embodiments, the end of the electrical connector 102 may be fixed by other means, such as a threaded connection.

In an exemplary embodiment, each electrical connector 102 includes a shielding gasket 120 at the separable mating interface. The shielding gasket 120 provides electrical shielding at the interface between the electrical connector 102 and the circuit board 104, 106. The shielding gasket 120 prevents EMI leakage at the interface with the circuit board 104, 106. In an exemplary embodiment, the shielding gasket 120 is compressible such that the shielding gasket 120 is compressed between the electrical connector 102 and the circuit board 104, 106 when the electrical connector 102 is spring loaded against the circuit board 104, 106.

Figure 3:
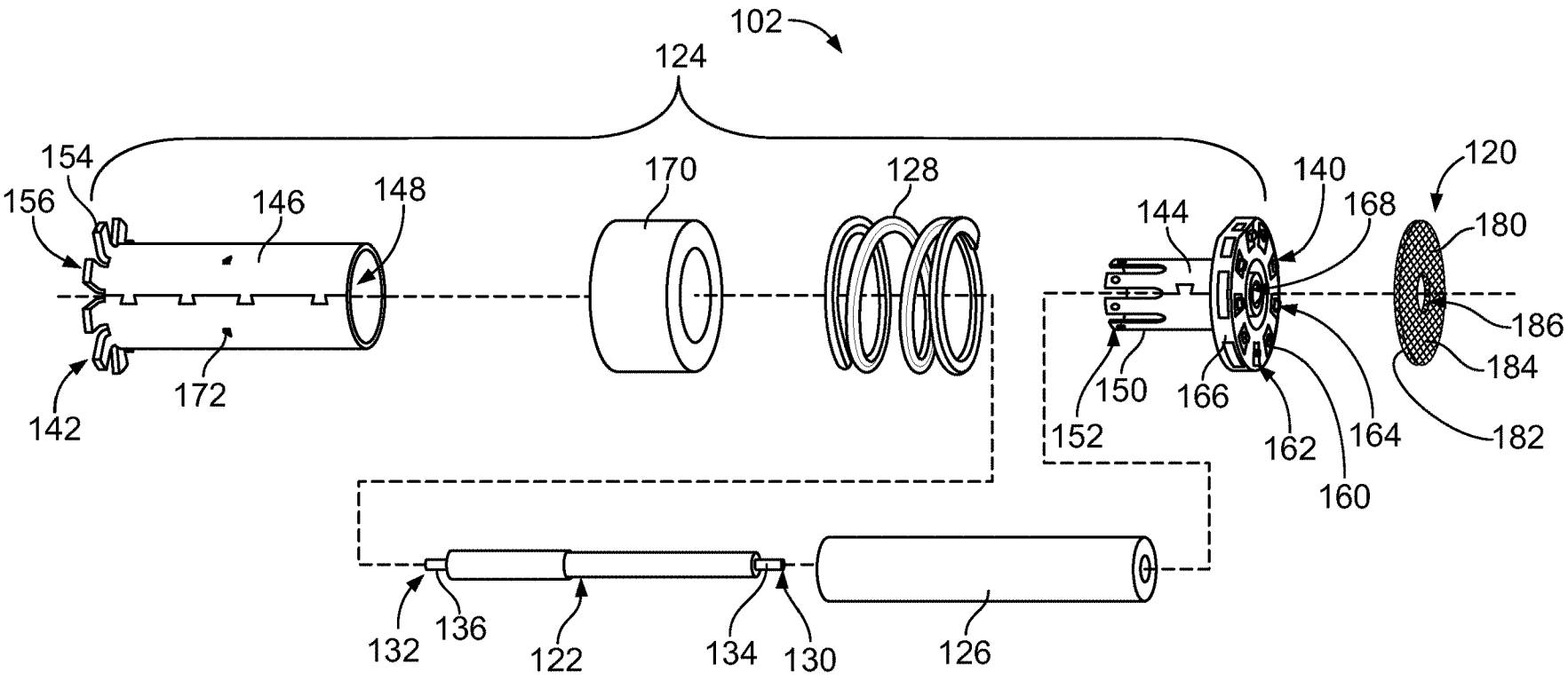
FIG. 3 is an exploded view of the electrical connector in accordance with an exemplary embodiment.

FIG. 3 is an exploded view of the electrical connector 102 in accordance with an exemplary embodiment. The electrical connector 102 includes an inner conductor 122 and an outer conductor 124. The electrical connector 102 may include an insulator 126 configured to be positioned between the inner conductor 122 and the outer conductor 124 in various embodiments. The inner conductor 122 is in electrical communication with and proximate to the outer conductor 124. For example, the outer conductor 124 may include an inner region that receives the inner conductor 122. In an exemplary embodiment, the inner conductor 122 is received in the outer conductor 124 and is coaxial with the outer conductor 124. The inner conductor 122 is a signal conductor and the outer conductor 124 provides electrical shielding for the inner conductor 122. The shielding gasket 120 is configured to be coupled to an end of the outer conductor 124. In an exemplary embodiment, the electrical connector 102 is a spring-loaded coaxial connector. The electrical connector 102 includes a biasing spring 128 coupled to the outer conductor 124 to spring load the outer conductor 124.

In various embodiments, the inner conductor 122 is configured to be received in the insulator 126. The inner conductor 122 extends between a first mating end 130 and a second mating end 132. The first mating end 130 is configured to be coupled to the first circuit board 104 (shown in FIG. 1) and the second mating end 132 is configured to be coupled to the second circuit board 106 (shown in FIG. 1). In various embodiments, the inner conductor 122 includes a pin 134 at the first mating end 130 and a pin 136 at the second mating end 132. Other types of mating interfaces may be provided in alternative embodiments. The pins 134, 136 may be solder pins, compliant pins, compression pins, or other types of pins. In an exemplary embodiment, the pin 136 is configured to be permanently coupled to the second circuit board 106, such as being soldered or press-fit into a via of the second circuit board 106. In an exemplary embodiment, the pin 134 is configured to be separably coupled to the first circuit board 104. For example, the inner conductor 122 may be a spring-loaded conductor having an internal spring that forces the first pin 134 away from the second pin 136 to press the pin 134 into electrical contact with the first circuit board 104. The inner conductor 122 may include a first inner conductor body and a second inner conductor body that are axially movable relative to each other.

The outer conductor 124 extends between a first mating end 140 and a second mating end 142. The first mating end 140 is configured to be coupled to the first circuit board 104 and the second mating end 142 is configured to be coupled to the second circuit board 106. In an exemplary embodiment, the outer conductor 124 is a multipiece outer conductor including a first outer conductor body 144 and a second outer conductor body 146 axially movable relative to each other. For example, the first outer conductor body 144 may be received within a bore 148 of the second outer conductor body 146 and slidable within the bore 148 relative to the second outer conductor body 146. In an exemplary embodiment, the outer conductor bodies 144, 146 are cylindrical. The first outer conductor body 144 includes connecting tabs 150 configured to be pressed outward against an interior surface of the second outer conductor body 146 to maintain electrical contact between the first outer conductor body 144 and the second outer conductor body 146. In various embodiments, the connecting tabs 150 include protrusions 152 that define mating interfaces between the connecting tabs 150 and the second outer conductor body 146.

In an exemplary embodiment, the second outer conductor body 146 includes ground beams 154 at the second mating end 142. The ground beams 154 are configured to be electrically connected to the second circuit board 106. In the illustrated embodiment, the ground beams 154 are bent outward, such as perpendicular to the second outer conductor body 146 for mounting to the second circuit board 106. The ground beams 154 are provided around an outer perimeter of the second outer conductor body 146. The ground beams 154 include surfaces 156 configured to be electrically connected to the second circuit board 106. The surfaces 156 may be generally planar. In an exemplary embodiment, the ground beams 154 are configured to be soldered to the second circuit board 106. Other types of grounding features may be provided in alternative embodiments.

In an exemplary embodiment, the first outer conductor body 144 includes mating pads 160 disposed around the perimeter of the first mating end 130. The mating pads 160 are configured to be electrically connected to the first circuit board 104. In the illustrated embodiment, the mating pads 160 are bent outward, such as perpendicular to the first outer conductor body 144 for electrical connection to the first circuit board 104. The mating pads 160 are provided around an outer perimeter of the first outer conductor body 144. The mating pads 160 have outer surfaces 162 configured to face the first circuit board 104. In an exemplary embodiment, the mating pads 160 include protrusions at the outer surfaces 162 defining separable mating interfaces. The protrusions 164 may be bumps formed in the mating pads 160, such as by coining the mating pads 160 to form the protrusions 164. The outer surfaces 162 of the mating pads 160 may be generally co-planer with the protrusions 164 extending outward from the outer surfaces 162 such that the protrusions 164 are configured to be mated with the first circuit board 104. Other types of mating pads may be provided in alternative embodiments.

In an exemplary embodiment, the outer conductor 124 includes a base 166 holding the mating pads 160. The base 166 is provided at the first mating end 140. The outer surfaces 162 of the mating pads 160 are exposed at an outer end of the base 166. In an exemplary embodiment, the base 166 is manufactured from a dielectric material, such as a plastic material. The base 166 may be molded in place at the first mating end 140. Alternatively, the base 166 may be coupled to the first mating end 140 of the first outer conductor body 144. The base 166 includes a central opening 168 configured to receive the first mating end 130 of the inner conductor 122.

In an exemplary embodiment, the electrical connector 102 includes a spring support 170 configured to be coupled to the outer conductor 124, such as to shoulders 172 on the second outer conductor body 146. The spring support 170 is used to support the biasing spring 128 relative to the second outer conductor body 146. In an exemplary embodiment, the biasing spring 128 is configured to engage an inner end of the base 166. The biasing spring 128 presses outward against the base 166 to spring load the first outer conductor body 144 relative to the second outer conductor body 146.

The shielding gasket 120 is configured to be coupled to the outer conductor 124. For example, the shielding gasket 120 is configured to be coupled to the first mating end 140 of the outer conductor 124. In an exemplary embodiment, the shielding gasket 120 is configured to be electrically connected to the mating pads 160. The shielding gasket 120 may provide electrical shielding in the spaces between the mating pads 160. In an exemplary embodiment, the shielding gasket 120 is ring-shaped having an inner conductor opening 186 configured to receive the first mating end 130 of the inner conductor 122. The inner conductor opening 186 is sized and shaped to isolate the gasket body 180 from the first mating end 130 of the inner conductor 122. The shielding gasket 120 may have other shapes in alternative embodiments.

The shielding gasket 120 includes a gasket body extending between an inner surface 182 and an outer surface 184. The inner surface 182 is mounted to the outer end of the base 166. For example, the gasket body 180 may be secured to the base 166 using adhesive. The outer surface 184 faces outward and is configured to interface with the first circuit board 104. In an exemplary embodiment, the gasket body 180 is compressible between the inner surface 182 and the outer surface 184. In an exemplary embodiment, the gasket body 180 is manufactured from a conductive material such that the shielding gasket 120 provides electrical shielding at the first mating end 140. For example, the gasket body 180 may be manufactured from an elastomer material having conductive fillers. The gasket body 180 may be molded from the elastomer material and the conductive fillers. In other various embodiments, the gasket body 180 may be manufactured from nonconductive fibers and/or conductive fibers, which may be woven or otherwise interspersed to form the gasket body 180. In other various embodiments, the gasket body 180 may be a stamped component. The shielding gasket 120 may have a shape similar to the shape of the base 166, such as a circular shape. However, the shielding gasket 120 may have other shapes in alternative embodiments, such as a rectangular shape, an irregular shape, or another shape in alternative embodiments. The shape of the shielding gasket 120 may be different than the shape of the base 166 in alternative embodiments, such as being larger or smaller than the base 166.

The shielding gasket 120 extends around the perimeter of the electrical connector 102. The shielding gasket 120 provides complete and effective electrical shielding for the perimeter of the electrical connector 102 at the interface with the first electrical component 104. For example, the shielding gasket 120 may extend entirely, continuously around the inner conductor opening 186 to provide electrical shielding around the entire perimeter of the inner conductor opening 186. In other various embodiments, the shielding gasket 120 may extend nearly entirely circumferentially around the inner conductor opening 186, such as around a majority of the inner conductor opening 186. For example, the shielding gasket 120 may be discontinuous or include pieces or gaps that are separated by sufficiently narrow spacing to provide efficient electrical shielding. The size of the gaps may be dependent on the target frequencies the electrical connector 102 is intended to operate at for effective shielding. The shielding gasket 120 may be provided at the outer perimeter (for example, the outer edge) of the outer conductor 124. In other various embodiments, the shielding gasket 120 may be located remote from the outer perimeter of the outer conductor 124, such as at a location between the outer perimeter of the outer conductor and the conductor opening 186. The shielding gasket 120 may be provided at the conductor opening 186.

Figure 4:
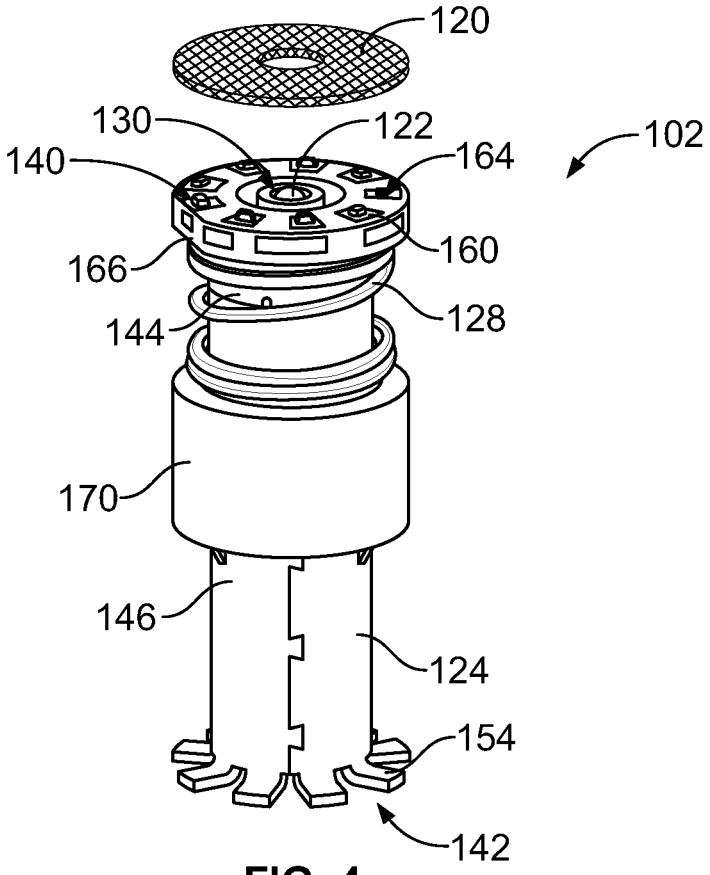
FIG. 4 is a side perspective view of the electrical connector in accordance with an exemplary embodiment.
Figure 5:
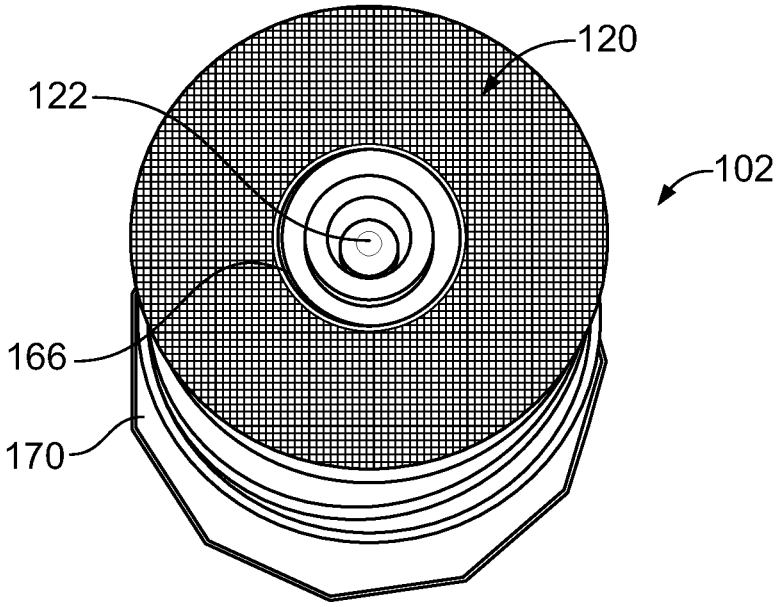
FIG. 5 is an end perspective view of the electrical connector in accordance with an exemplary embodiment.

FIG. 4 is a side perspective view of the electrical connector 102 in accordance with an exemplary embodiment. FIG. 5 is an end perspective view of the electrical connector 102 in accordance with an exemplary embodiment. FIG. 4 illustrates the electrical connector 102 with the shielding gasket 120 poised for coupling to the first mating end 140 of the outer conductor 124. FIG. 5 illustrates the shielding gasket 120 coupled to the first mating end 140 of the outer conductor 124.

When assembled, the inner conductor 122 is received in the outer conductor 124 such that the inner conductor 122 and the outer conductor 124 are coaxial. The inner conductor 122 passes through the first outer conductor body 144 and the second outer conductor body 146. The biasing spring 128 is coupled between the spring support 170 and the base 166 at the first mating end 140 of the outer conductor 124. The biasing spring 128 presses the first outer conductor body 144 outward away from the second mating end 142. The mating pads 160 are configured to be pressed outward away from the ground beams 154. The shielding gasket 120 is configured to be coupled to the first mating end 140. The shielding gasket 120 covers the mating pads 160. The shielding gasket 120 is electrically connected to the mating pads 160. The shielding gasket 120 is located in the gaps or spaces between the mating pads 160. The shielding gasket 120 provides perimeter shielding around the first mating end 130 of the inner conductor 122. The protrusions 164 may press into the shielding gasket 120 and/or may press through the shielding gasket 120.

Figure 6:
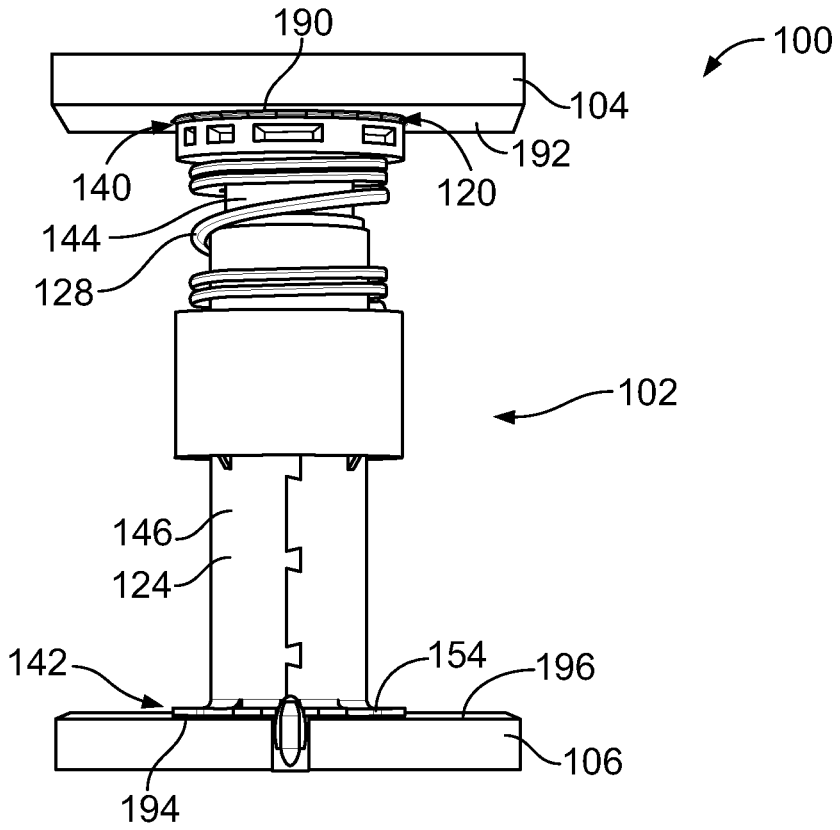
FIG. 6 illustrates a portion of the communication system showing the electrical connector electrically connected between circuit boards.

FIG. 6 illustrates a portion of the communication system 100 showing the electrical connector 102 electrically connected between the first circuit board 104 and the second circuit board 106. The second outer conductor body 146 is coupled to the second circuit board 106 at the second mating end 142. For example, the ground beams 154 are soldered to ground pads 194 at a second mounting surface 196 of the second circuit board 106.

The first outer conductor body 144 is coupled to the first circuit board 104 at the first mating end 140. For example, the mating pads 160 are electrically connected to ground pads 190 at a first mounting surface 192 of the first circuit board 104. In an exemplary embodiment, the outer conductor 124 is coupled to the first circuit board 104 at a separable mating interface. For example, the mating pads 160 are spring loaded against the ground pads 190 of the first circuit board 104 by the biasing spring 128. The biasing spring 128 is compressible between the first and second circuit boards 104, 106. The shielding gasket 120 is compressible at the mating interface between the electrical connector 102 in the first circuit board 104.

Figure 7:
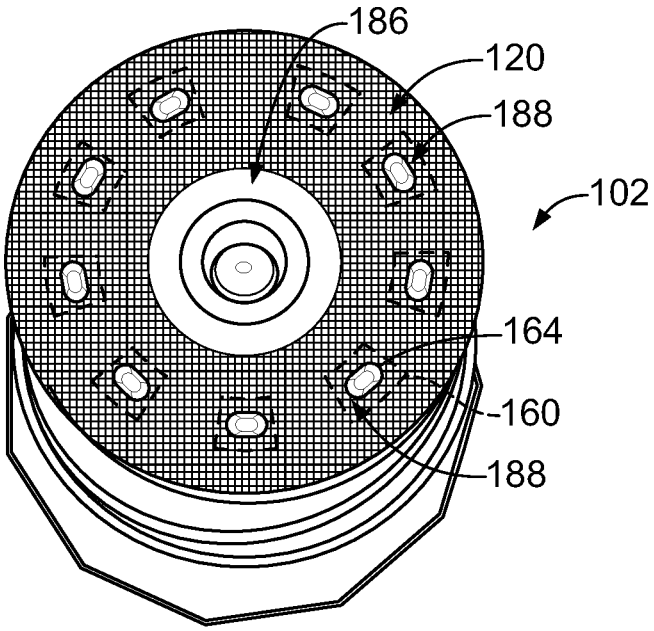
FIG. 7 is a perspective view of the electrical connector in accordance with an exemplary embodiment.

FIG. 7 is a perspective view of the electrical connector 102 in accordance with an exemplary embodiment. FIG. 7 illustrates the shielding gasket 120 having a plurality of pad openings 188 aligned with corresponding mating pads 160. The pad openings 188 allow the protrusions 164 of the mating pads 160 to pass through the shielding gasket 120 for direct electrical connection with the first circuit board 104. The material of the shielding gasket 120 is provided between the pad openings 188. The material of the shielding gasket 120 is provided radially outward of the pad openings 188. The material of the shielding gasket 120 is provided between the pad openings 188 and the inner conductor opening 186. The material of the shielding gasket 120 may cover portions of the mating pads 160 while exposing the protrusions 164 to allow the protrusions 164 to pass through the shielding gasket 120.

Figure 8:
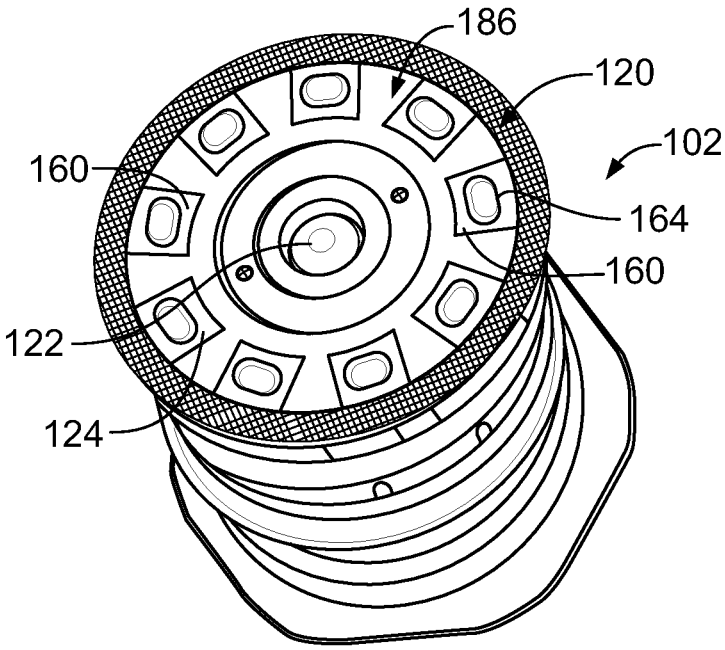
FIG. 8 is a perspective view of the electrical connector in accordance with an exemplary embodiment.

FIG. 8 is a perspective view of the electrical connector 102 in accordance with an exemplary embodiment. FIG. 8 illustrates the shielding gasket 120 is ring-shaped having a large central opening 186 that surrounds the mating pads 160 in addition to the inner conductor 122. The shielding gasket 120 extends around the outer perimeter of the outer conductor 124 to provide perimeter shielding around the outside of the mating pads 160. Optionally, a separate ring-shaped shielding gasket 120 may be provided between the mating pads 160 and the inner conductor 122. The protrusions 164 extend through the opening 186.

Figure 9:
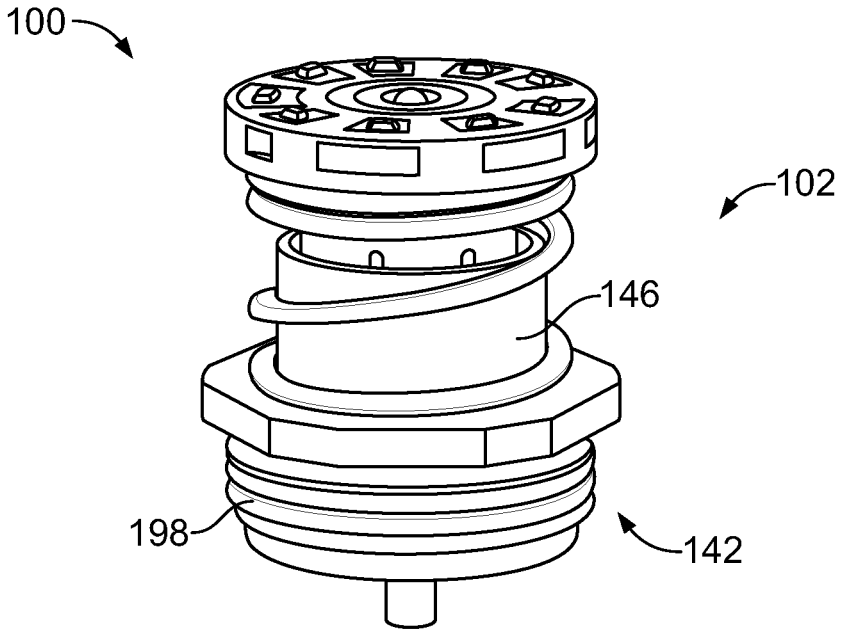
FIG. 9 illustrates a portion of the communication system in accordance with an exemplary embodiment.

FIG. 9 illustrates a portion of the communication system 100 in accordance with an exemplary embodiment. The electrical connector 102 includes a different type of mating interface at the second mating end 142. For example, in the illustrated embodiment, the second outer conductor body 146 includes threads 198 at the second mating end 142. The second mating end 142 is configured to be threadably coupled to the second component, such as the second circuit board 106 or a threaded connector, which may be mounted to the second circuit board 106 or separate from any circuit board.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A electrical connector comprising:

an inner conductor having a first mating end and a second mating end, the first mating end of the inner conductor configured to be coupled to an electrical component;

an outer conductor having a first mating end and a second mating end, the outer conductor having an inner region receiving the inner conductor, the inner conductor being in electrical communication with and proximate to the outer conductor, the first mating end of the outer conductor configured to be coupled to the electrical component; and a shielding gasket separate and discrete from the outer conductor, the shielding gasket being coupled to the first mating end of the outer conductor, the shielding gasket having an outer surface facing the electrical component and configured to interface with the electrical component, the shielding gasket being electrically conductive, the shielding gasket providing perimeter shielding for the first mating end of the inner conductor.

2. The electrical connector of claim 1, wherein the shielding gasket is compressible between the first mating end and the electrical component.

3. The electrical connector of claim 1, wherein the shielding gasket is continuous around an entire perimeter of the first mating end.

4. The electrical connector of claim 1, wherein the shielding gasket includes an inner conductor opening that receives the first mating end of the inner conductor, the shielding gasket providing complete shielding for the first mating end of the inner conductor at the interface with the electrical component.

5. The electrical connector of claim 1, wherein the inner conductor is coaxial with the outer conductor.

6. The electrical connector of claim 1, wherein the electrical component is a circuit board, the first mating end of the inner conductor defining a board interface for interfacing with the circuit board, the first mating end of the outer conductor defining a board interface for interfacing with the circuit board.

7. The electrical connector of claim 1, wherein the outer conductor includes mating pads disposed around the perimeter of the first mating end, the shielding gasket being electrically connected to each of the mating pads.

8. The electrical connector of claim 1, wherein the shielding gasket includes a ring body having an inner conductor opening, the inner conductor passing through the inner conductor opening to electrically connect to the electrical component.

9. The electrical connector of claim 1, wherein the outer conductor includes mating pads disposed around the perimeter of the first mating end, each mating pad having a protrusion defining a mating interface configured to interface with the electrical component, the shielding gasket including pad openings therethrough aligned with corresponding protrusions to allow the protrusions to pass through the shielding gasket.

10. The electrical connector of claim 1, wherein the shielding gasket includes an inner surface and an outer surface, the inner surface interfacing with the first mating end of the outer conductor, the outer surface facing the electrical component to interface with the electrical component.

11. The electrical connector of claim 1, further comprising a biasing spring coupled to the outer conductor, the second mating end of the outer conductor configured to be soldered to a second electrical component, the first mating end of the outer conductor being spring biased toward the electrical component to electrically connect to the electrical component at a spring biased, separable mating interface.

12. The electrical connector of claim 1, wherein the outer conductor includes a first outer conductor body and a second outer conductor body coupled to the first outer conductor body and axially movable relative to the first outer conductor body, the first outer conductor body extending to the first mating end and including mating pads at the first mating end, the mating pads being electrically coupled to ground pads of the electrical component, the second outer conductor body extending to the second mating end and including ground beams at the second mating end, the ground beams being electrically coupled to ground pads of a second electrical component.

13. The electrical connector of claim 12, further comprising a biasing spring coupled to the outer conductor, the biasing spring biasing the first mating end of the first outer conductor body away from the second mating end of the second outer conductor body, at least one of the mating pads and the ground beams being spring biased against the corresponding ground pads at a separable mating interface.

14. A electrical connector comprising:

an inner conductor having a first mating end and a second mating end, the inner conductor being compressible between the first mating end and the second mating end, the first mating end of the inner conductor configured to be coupled to an electrical component;

an outer conductor having a first mating end and a second mating end, the outer conductor being compressible between the first mating end and the second mating end, the outer conductor having an inner region receiving the inner conductor, the inner conductor being in electrical communication with and proximate to the outer conductor, the first mating end of the outer conductor configured to be coupled to the electrical component;

a biasing spring coupled to the outer conductor to bias the first mating end of the outer conductor away from the second mating end of the outer conductor; and a shielding gasket separate and discrete from the outer conductor, the shielding gasket being coupled to the first mating end of the outer conductor, the shielding gasket having an outer surface facing the electrical component and configured to interface with the electrical component, the shielding gasket being electrically conductive, the shielding gasket providing perimeter shielding for the first mating end of the inner conductor.

15. The electrical connector of claim 14, wherein the shielding gasket includes an inner conductor opening that receives the first mating end of the inner conductor, the shielding gasket providing complete shielding for the first mating end of the inner conductor at an interface with the electrical component.

16. The electrical connector of claim 14, wherein the electrical component is a circuit board, the first mating end of the inner conductor defining a board interface for interfacing with the circuit board, the first mating end of the outer conductor defining a board interface for interfacing with the circuit board.

17. The electrical connector of claim 14, wherein the shielding gasket includes a ring-shaped body having an inner conductor opening, the inner conductor passing through the inner conductor opening to electrically connect to the electrical component.

18. The electrical connector of claim 14, wherein the outer conductor includes mating pads disposed around the perimeter of the first mating end, each mating pad having a protrusion defining a mating interface configured to interface with the electrical component, the shielding gasket including pad openings therethrough aligned with corresponding protrusions to allow the protrusions to pass through the shielding gasket.

19. The electrical connector of claim 14, wherein the outer conductor includes a first outer conductor body and a second outer conductor body coupled to the first outer conductor body and axially movable relative to the first outer conductor body, the biasing spring pressing the first outer conductor body outward relative to the second outer conductor body, the first outer conductor body extending to the first mating end and including mating pads at the first mating end, the mating pads being electrically coupled to ground pads of the electrical component, the second outer conductor body extending to the second mating end and including ground beams at the second mating end, the ground beams being electrically coupled to ground pads of a second electrical component.

20. The electrical connector of claim 14, wherein the outer conductor includes a first outer conductor body and a second outer conductor body coupled to the first outer conductor body and axially movable relative to the first outer conductor body, the biasing spring biasing the first mating end of the first outer conductor body away from the second mating end of the second outer conductor body, at least one of the first mating end and the second mating end being spring biased against the corresponding electrical component at a separable mating interface.

21. A communication system comprising:

a first electrical component having first mounting surface;

a second electrical component having a second mounting surface; and an electrical connector electrically connected between the first electrical component and the second electrical component, the electrical connector comprising:

an inner conductor having a first mating end coupled to the first mounting surface and a second mating end coupled to the second mounting surface, the inner conductor being electrically connected to the first electrical component and the second electrical component;

an outer conductor having a first mating end and a second mating end, the outer conductor including an inner region receiving the inner conductor, the outer conductor being in electrical communication with and proximate to the inner conductor, the first mating end of the outer conductor coupled to the first mounting surface, the second mating end of the outer conductor coupled to the second mounting surface, the outer conductor being electrically connected to the first electrical component and the second electrical component;

a biasing spring coupled to the outer conductor to bias the first mating end of the outer conductor away from the second mating end of the outer conductor; and a shielding gasket separate and discrete from the outer conductor, the shielding gasket being coupled to the first mating end of the outer conductor, the shielding gasket having an outer surface facing the first mounting surface and configured to interface with the first electrical component at the first mounting surface, the shielding gasket being electrically conductive, the shielding gasket providing perimeter shielding for the first mating end of the inner conductor.

22. The communication system of claim 21, wherein the inner conductor is compressible between the first mating end and the second mating end of the inner conductor, and wherein the outer conductor is compressible between the first mating end and the second mating end of the outer conductor.

23. The communication system of claim 21, wherein the outer conductor includes a first outer conductor body and a second outer conductor body coupled to the first outer conductor body and axially movable relative to the first outer conductor body, the biasing spring pressing the first outer conductor body outward relative to the second outer conductor body, the first outer conductor body extending to the first mating end and including mating pads at the first mating end, the mating pads being electrically coupled to ground pads of the electrical component, the second outer conductor body extending to the second mating end and including ground beams at the second mating end, the ground beams being electrically coupled to ground pads of the second electrical component.

24. The communication system of claim 21, wherein the outer conductor includes a first outer conductor body and a second outer conductor body coupled to the first outer conductor body and axially movable relative to the first outer conductor body, the biasing spring biasing the first mating end of the first outer conductor body away from the second mating end of the second outer conductor body, at least one of the first mating end and the second mating end being spring biased against the corresponding electrical component at a separable mating interface.

25. The communication system of claim 21, wherein the shielding gasket includes an inner surface and an outer surface, the inner surface interfacing with the first mating end of the outer conductor, the outer surface facing the electrical component to interface with the electrical component.

26. The electrical connector of claim 14, wherein the shielding gasket includes an inner surface and an outer surface, the inner surface interfacing with the first mating end of the outer conductor, the outer surface facing the electrical component to interface with the electrical component.

* * * * *